US008312823B2

(12) United States Patent
Kondou

(10) Patent No.: US 8,312,823 B2
(45) Date of Patent: Nov. 20, 2012

(54) SEWING MACHINE

(75) Inventor: Tetsurou Kondou, Tajimi (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 18 days.

(21) Appl. No.: 12/949,016

(22) Filed: Nov. 18, 2010

(65) Prior Publication Data

US 2011/0113998 A1 May 19, 2011

(30) Foreign Application Priority Data

Nov. 18, 2009 (JP) ..... 2009-263256

(51) Int. Cl.
*D05C 3/02* (2006.01)

(52) U.S. Cl. ..... 112/98

(58) Field of Classification Search ..... 112/99, 112/113, 139, 152, 220, 254, 255, 302, 305, 112/278, 470.33, 273, 228, 231, 248, 279
See application file for complete search history.

(56) References Cited

U.S. PATENT DOCUMENTS

| | | | | |
|---|---|---|---|---|
| 740,654 | A * | 10/1903 | Hochstrasser | 112/99 |
| 797,308 | A * | 8/1905 | Nassberg | 112/99 |
| 7,290,493 | B2 * | 11/2007 | Suzuki et al. | 112/220 |
| 7,370,592 | B2 * | 5/2008 | Tajima et al. | 112/220 |
| 7,469,649 | B2 * | 12/2008 | Watanabe | 112/278 |

FOREIGN PATENT DOCUMENTS

JP 3-286797 A 12/1991

* cited by examiner

*Primary Examiner* — Tejash Patel
(74) *Attorney, Agent, or Firm* — Rossi, Kimms & McDowell LLP

(57) ABSTRACT

A guide member is moved in interlocked relation to a rotary member rotating about the axis of a needle bar, so that a string-shaped material paid out from a bobbin is guided to a needle drop position of a sewing needle. The bobbin having the string-shaped material wound thereon is supported by a support member that is rotatable generally about the axis of the needle bar and disposed over a machine table in such a manner as to not hamper movement of an embroidery frame. The bobbin can be positioned at a distance from a machine head; thus, bobbins of increased sizes can be used. The support member is controlled in orientation, by means of a drive source, in accordance with rotation of the rotary member. The bobbin itself revolves around the machine head, which allows the string-shaped material to be constantly appropriately guided to the needle drop position.

4 Claims, 5 Drawing Sheets

SEWING MACHINE

BACKGROUND

The present invention relates generally to sewing machines of a type which sews a string-shaped material, such as a tape or cord, to a sewing workpiece, such as a fabric, through lock switching. More particularly, the present invention relates to an improved sewing machine in which a large bobbin, capable of winding thereon a large amount of a string-shaped material, is controlled in orientation in response to rotation of a rotary member so that the string-shaped material can constantly be appropriately directed to a needle drop position.

Heretofore, there have been known sewing machines of a type which includes: a vertically-driven needle bar; a sewing needle fixed to a lower end portion of the needle bar; a rotary member mounted coaxially with the needle bar and freely rotatable about its axis; a bobbin having a string-shaped material wound thereon; and a guide member fixed to the rotary member for guiding the string-shaped material (e.g., string-shaped embroidering material, such as a tape or cord) to a sewing position or needle drop position of the sewing needle. The sewing machines of this type operate to sew the string-shaped material onto a fabric through lock stitching, by the rotation of the rotary member being appropriately controlled in accordance with a moving direction of the fabric based on embroidery data and by the orientation of the guide member being appropriately changed to optimize the direction in which the string-shaped material is to be guided to the needle drop position. In such sewing machines, the bobbin having the string-shaped material wound thereon is attached to the rotary member and the rotation of the rotary member is controlled in accordance with sewing control based on the embroidery data, in response to which the bobbin attached to the rotary member also rotates together with the guide member. With such movement, the string-shaped material can always be directed to needle drop position in an appropriate manner. However, with the aforementioned conventionally-known sewing machines, where the bobbin is attached to the rotary member, attachable or usable bobbins would be considerably limited in size due to the bobbin-attaching portion (i.e., portion of the rotary member); namely, it is difficult to use large-size bobbins such that great amounts of a string-shaped materials can be wound thereon.

One example of a sewing machine designed to avoid the above-mentioned prior art problem is known from Japanese Patent Application Laid-open Publication No. HEI-3-286797 (hereinafter referred to as "the patent literature"). Namely, the patent literature discloses a sewing machine of the aforementioned type, which can realize a size increase of attachable or usable bobbins by allowing a bobbin, having a string-shaped material wound thereon, to be disposed (or attached) above the needle bar. In the sewing machine disclosed in the patent literature, a bobbin, having a string-shaped material wound thereon, is adapted to be disposed on (attached to) a bobbin shaft supported at its opposite end portions on a pair of support members that are in turn fixed to a machine frame so as to extend upward from the machine frame. The bobbin shaft supports opposite end portions of the bobbin by means of a pair of retention members provided on the bobbin shaft. In this manner, the bobbin, having the string-shaped material wound thereon, can be disposed at an upper position away from the needle bar, rotary member, etc. independently of the rotary member. Thus, bobbins to be used can be increased in size, and thus, increased amounts of string-shaped materials can be wound on the bobbins.

The conventionally-known sewing machine disclosed in the patent literature can achieve an increase in size of bobbins to be used, by disposing a bobbin, having a string-shaped material wound thereon, at an upper position away from the needle bar, rotary member, etc., as set forth above. However, in the sewing machine disclosed in the patent literature, the bobbin is fixedly disposed at the upper position so that its orientation is uncontrollable, although the rotary member can be rotated when the string-shaped material is to be sewn onto a sewing workpiece, such as a fabric. Thus, in a case where the rotary member is rotated through 360 degrees or over in accordance with sewing control based on embroidery data, for example, the string-shaped material paid out from the bobbin may undesirably wrap around a machine head and get entangled. In order to avoid such an inconvenience, there is a need to create in advance embroidery data such that the rotary member does not have to be rotated through 360 degrees or over. However, if the rotation of the rotary member is limited like this, there would occur another problem that patterns capable of being formed on a sewing workpiece are limited considerably.

Further, in the prior art sewing machine disclosed in the patent literature, the bobbin is disposed high above the machine head. This means that, at the time of mounting the bobbin to the machine, a human operator has to lift up the bobbin high above the machine head. However, a large-size bobbin having a large amount of a string-shaped material wound thereon would increase in weight, and thus, the operation for lifting up such a large-size, heavy-weight bobbin high above the machine head would undesirably require an extremely great force of the human operator and thereby impose a great load on the human operator.

SUMMARY OF THE INVENTION

In view of the foregoing, it is an object of the present invention to provide an improved sewing machine which can sew a desired pattern onto a sewing work piece without limitations even where a large-size bobbin capable of winding thereon a large amount of a string-shaped material is used, but also allows a large-size, heavy-weight bobbin having a large amount of a string-shaped material wound thereon to be readily mounted in place with a small force.

In order to accomplish the above-mentioned object, the present invention provides an improved sewing machine which includes: a vertically-driven needle bar; a sewing needle mounted to a lower end portion of the needle bar; a rotary member provided coaxially with the needle bar and freely rotatable about an axis thereof; a bobbin having a string-shaped material wound thereon; and a guide member mounted to the rotary member for guiding the string-shaped material, paid out from the bobbin, to a needle drop position of the sewing needle, and which is constructed to sew the string-shaped material onto a sewing workpiece by lock stitching while not only controlling rotation of the rotary member in accordance with a moving direction of a sewing workpiece held on an embroidery frame that moves on and along a machine table on the basis of embroidery data but also changing an orientation of the guide member in such a manner as to optimize the direction in which the string-shaped material is to be guided to the needle drop position, the sewing machine comprising: a support member for supporting the bobbin, the support member being rotatable generally about an axis of the needle bar and causing the bobbin to revolve around the axis of the needle bar in response to rotation of the support member; and a drive section for rotating the support member.

According to the present invention, a bobbin having a string-shaped material wound thereon is supported by the support member that is disposed over a machine table and rotatable generally about the axis of the needle bar. Therefore, the bobbin having the string-shaped material wound thereon can be positioned at a distance downward from a machine head including the needle bar (and the sewing needle), the rotary member (and the guide member), etc., and the sewing machine of the present invention can use bobbins of increased sizes, without bobbins usable in the present invention being significantly limited in size, unlike in the conventionally-known sewing machines where such a bobbin is attached to the rotary member. Further, the support member is subjected to orientation control performed by the drive motor in accordance with rotation control of the rotary member, and thus, as the rotary member is rotated through 360° or over, the support member rotates generally about the axis of the needle bar. As the support member rotates like this, the bobbin supported by the support member circularly moves or revolves around the machine head. Because the bobbin itself circularly moves or revolves around the machine head like this, the string-shaped material can always be appropriately guided to the needle drop position irrespective of the rotation of the rotary member. Namely, no matter how the rotary member has been rotated on the basis of embroidery data, the bobbin itself revolves around the machine head so as to follow the rotation of the rotary member. Thus, there is no possibility of the string-shaped material wrapping around the machine head and getting entangled, with the result that the string-shape material can be sewn onto a sewing workpiece without limitations on patterns to be formed on the sewing workpiece.

Preferably, the drive section controls rotation of the support member so as to follow the rotation of the rotary member. Further, the support member is disposed over the embroidery frame at a predetermined lower position in such a manner that the support member at least does not hamper movement of the embroidery frame. Because the support member is disposed over the machine table with a predetermined spacing from the upper surface of the machine table in such a manner that it does not hamper movement of the embroidery frame, the support member is positioned at a lower position rather close to the lower end of the machine head, as compared to the conventional counterpart. Thus, when mounting the bobbin to the support member, it is not necessary for the human operator to lift up the bobbin high as was necessary in the conventionally-known sewing machine, which can reduce a load on the human operator.

According to the present invention, the bobbin having the string-shaped material wound thereon is supported by the support member rotatably disposed over the machine table, and the rotation of the support table is controlled, in accordance with the rotation control of the rotary member, to cause the bobbin to revolve around the machine head. Thus, the sewing machine of the present invention can use bobbins of increased sizes, and can sew a string-shape material onto a sewing workpiece without presenting limitations on patterns to be formed on the sewing workpiece.

Further, because the support member is disposed over the machine table at a lower position, rather close to the lower end of the machine head, as compared to the conventional counterpart. Thus, unlike the conventionally-known sewing machines where the support member is disposed above the machine head, the present invention can eliminate the need for the human operator to lift up the bobbin high and thereby reduce a load on the human operator.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF DRAWINGS

For better understanding of the object and other features of the present invention, its preferred embodiments will be described hereinbelow in greater detail with reference to the accompanying drawings, in which.

DETAILED DESCRIPTION

Figure 1:
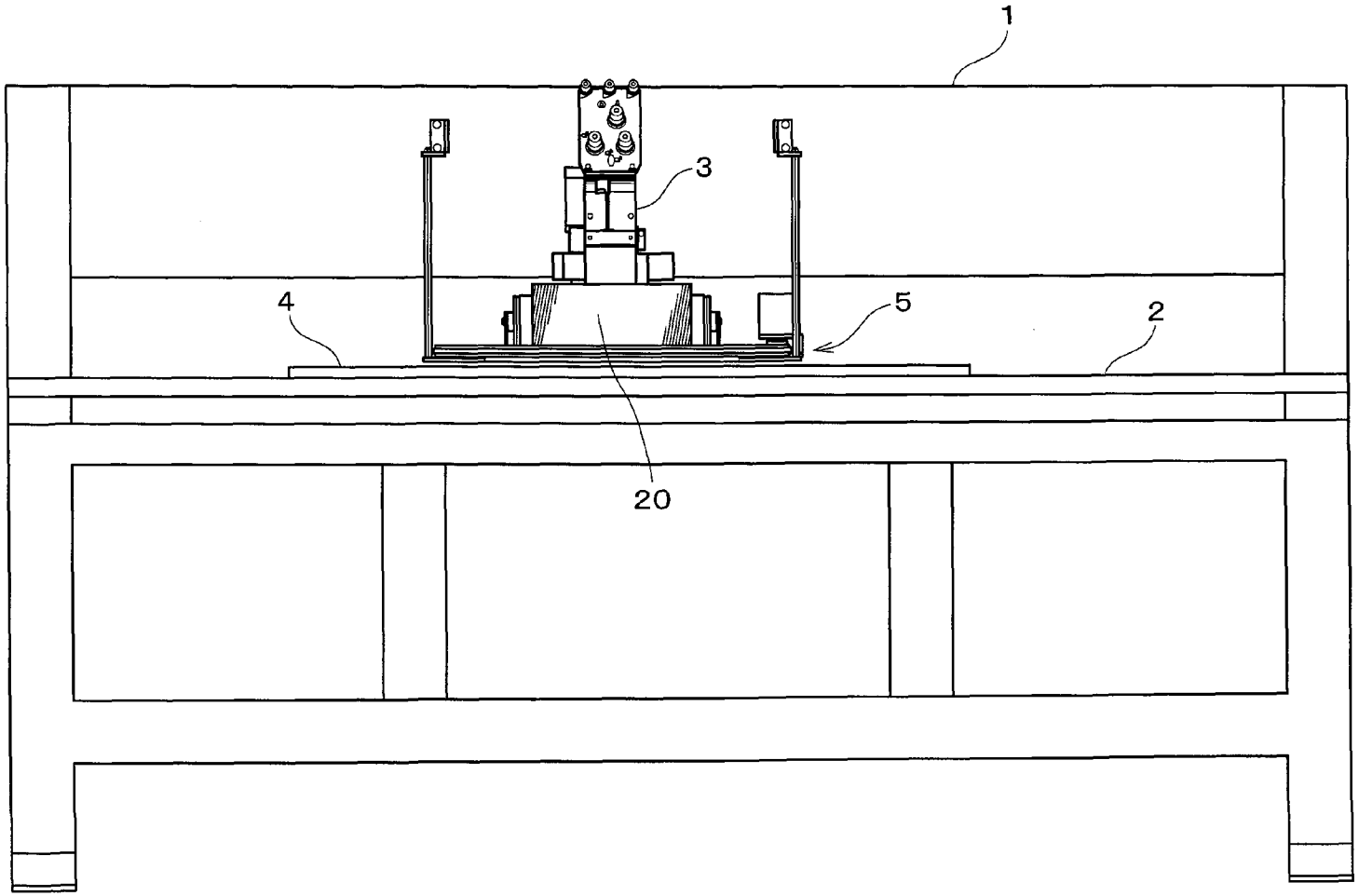
FIG. 1 is a front view showing an embodiment of an embroidering sewing machine of the present invention.
Figure 2:
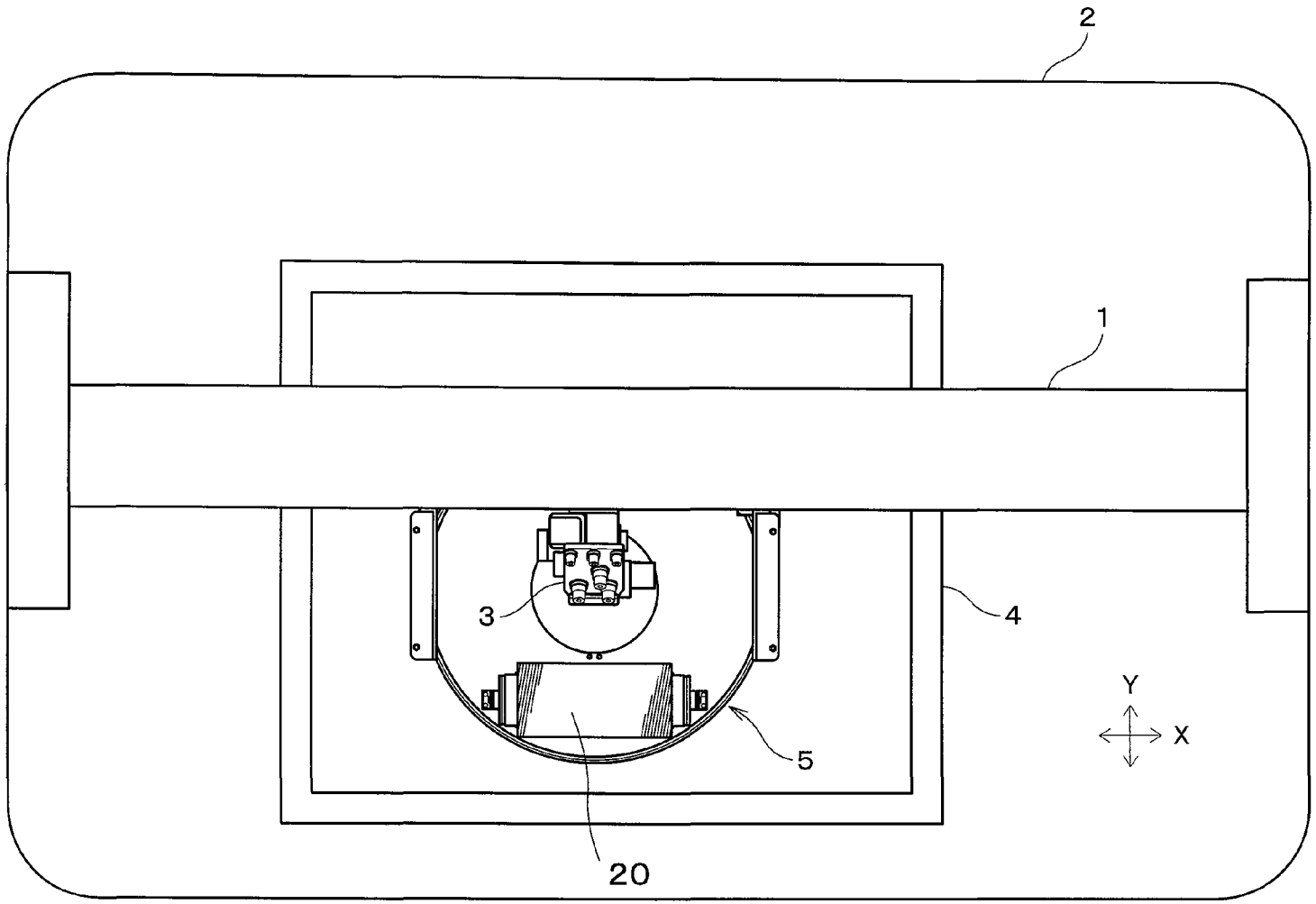
FIG. 2 is a plan view of the embroidering sewing machine shown in FIG. 1.

FIG. 1 is a front view showing an embodiment of an embroidering sewing machine of the present invention. FIG. 2 is a plan view of the embroidering sewing machine shown in FIG. 1. First, an outlined description will be given about a general construction of the embroidering sewing machine, with reference to FIGS. 1 and 2. Whereas a plurality of machine heads 3 constructed in the conventionally-known manner are disposed at predetermined intervals on the front surface of a machine frame 1 (corresponding to a side closer to a reader of FIG. 1 or a lower side in FIG. 2), only one of the machine heads 3 is shown in the figures to facilitate understanding of the following description.

As shown in FIGS. 1 and 2, the machine head 3, capable of sewing a string-shaped material, is mounted on the front surface of the machine frame 1, and a machine table 2 of a flat plate shape is mounted on the machine frame 1 under the machine head 3. An embroidery frame 4 for holing a sewing workpiece, such as a fabric, is provided on the machine table 2 in such a manner that it is movable in X and Y directions (left-right and up-down directions in FIG. 2) via a conventionally-known type drive section (not shown). Further, a bobbin support device 5 supporting a bobbin 20, having a string-shaped material wound thereon, is constructed to supply the string-shaped material to the machine head 3. This bobbin support device 5 is disposed over the machine table 2; more specifically, the bobbin support device 5 is provided on a predetermined mounting position positionally corresponding to the machine head 3 and with a predetermined spacing secured from the upper surface of the embroidery frame 4. Further details of the bobbin support device 5 will be discussed below.

Figure 3:
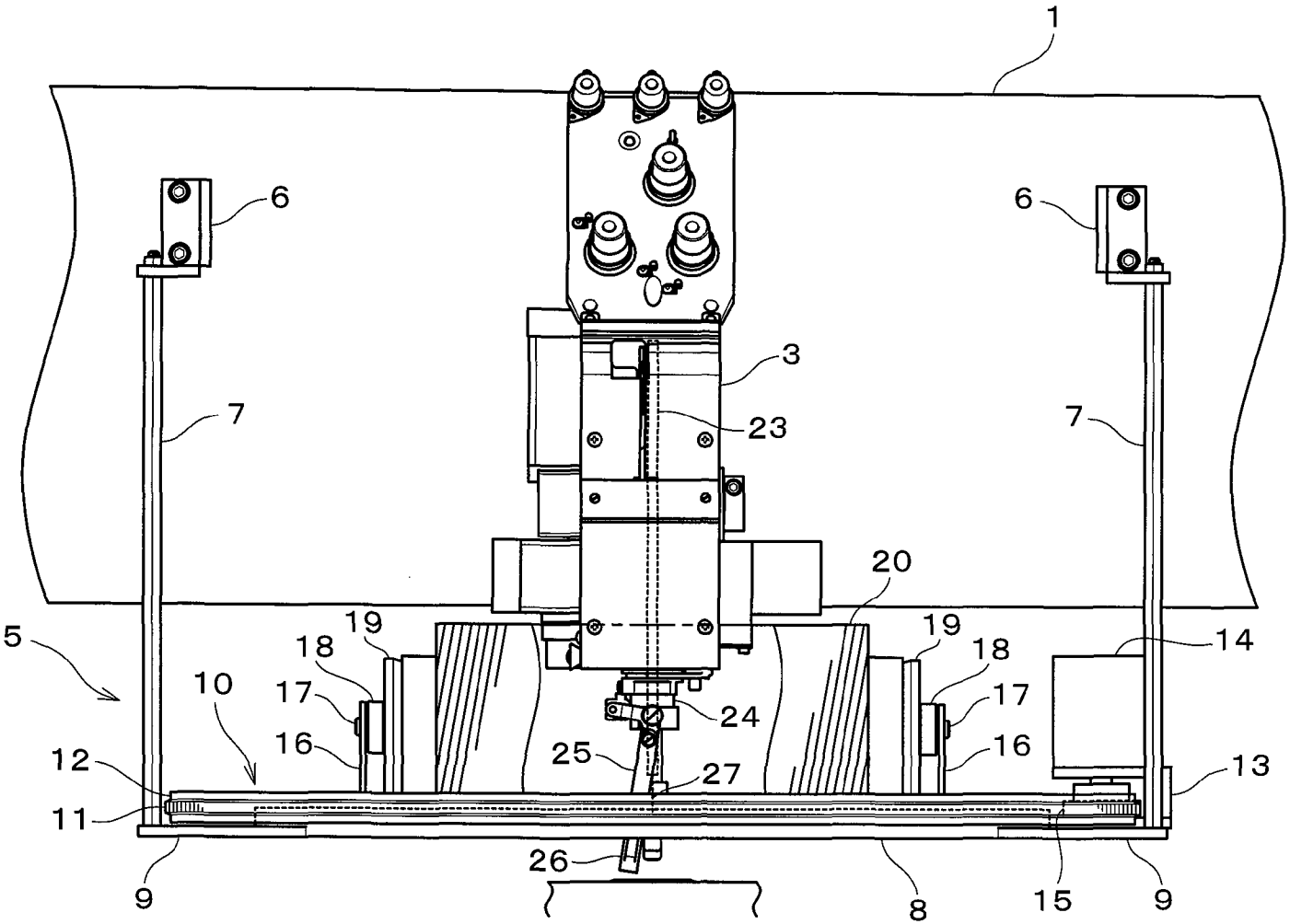
FIG. 3 is a front view explanatory of a bobbin support device employed in the embroidering sewing machine.
Figure 4:
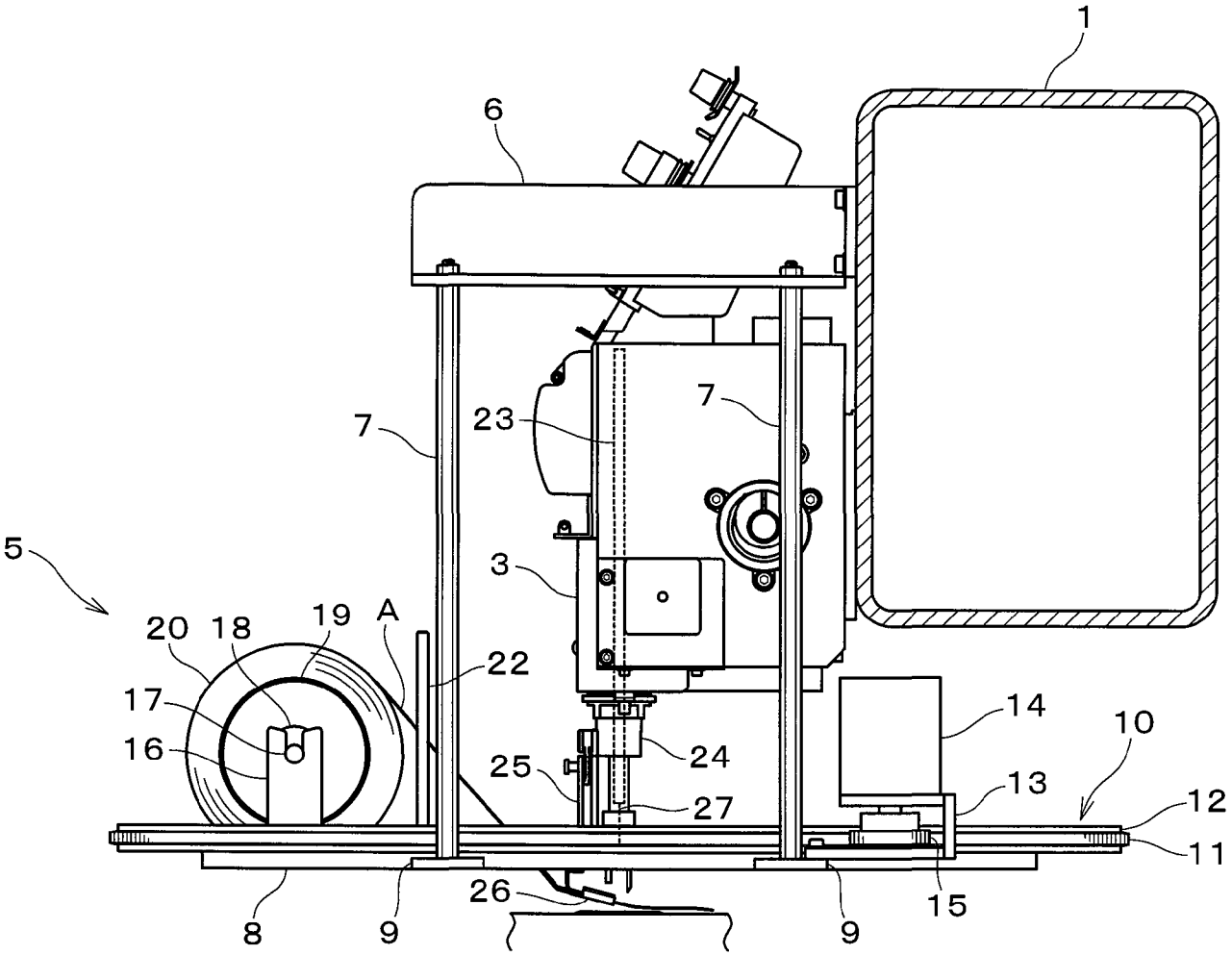
FIG. 4 is a right side view of the bobbin support device shown in FIG. 3.
Figure 5:
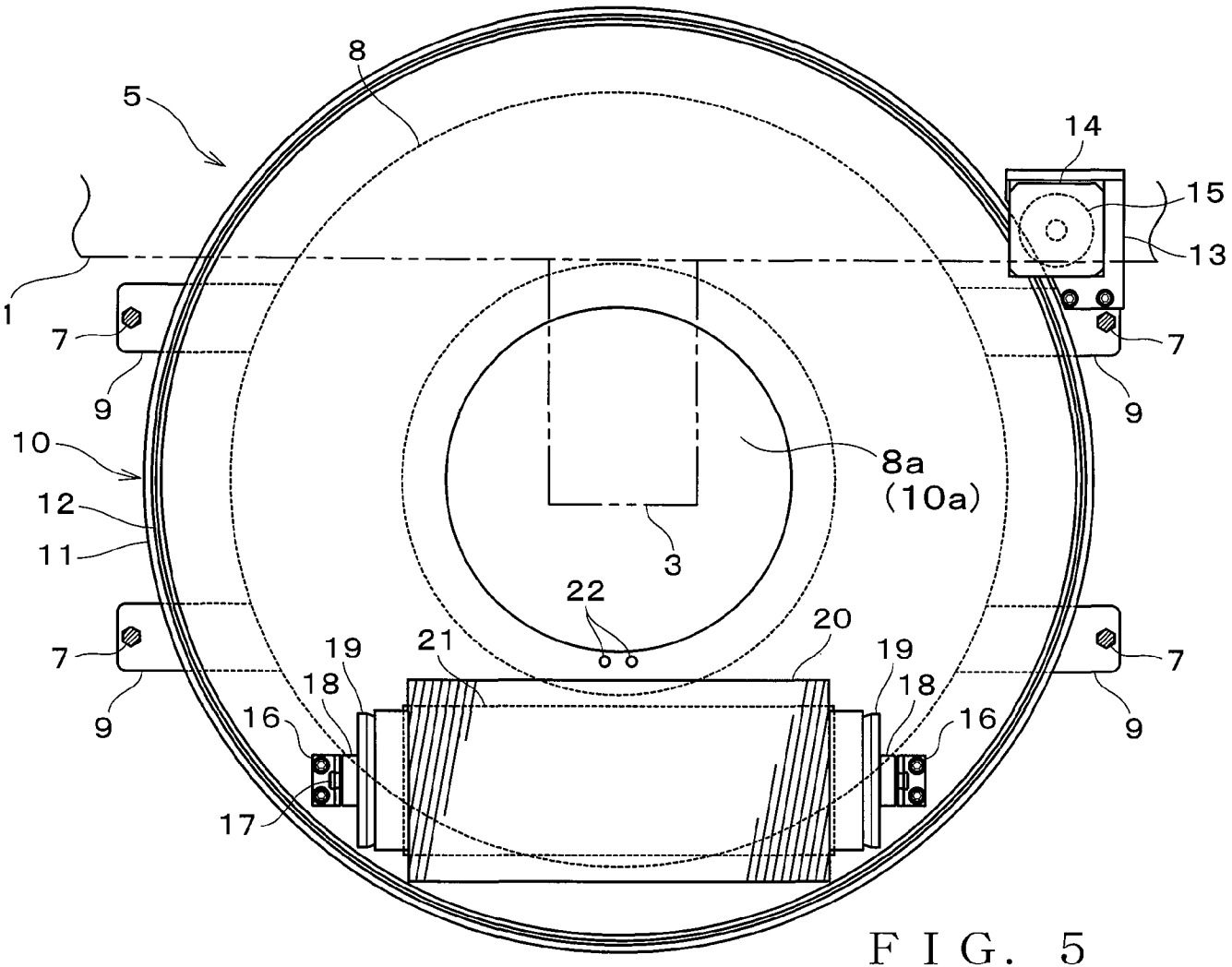
FIG. 5 is a plan view of the bobbin support device shown in FIG. 3.

FIG. 3 is a front view explanatory of the bobbin support device 5, FIG. 4 is a right side view of the bobbin support device 5 shown in FIG. 3, and FIG. 5 is a plan view of the bobbin support device 5 shown in FIG. 3.

Before going into a detailed description of the bobbin support device 5, the following briefly describe the machine head 3 with reference to FIGS. 3 and 4. The machine head 3 is of the conventionally-known type, which includes: a vertically-driven needle bar 23 of a conventionally-known construction and having a sewing needle 27 fixed to its lower end portion; a rotary member 24 mounted coaxially with the needle bar 23 and freely rotatable about its axis; a guide lever 25 mounted to the rotary member 24 and driven to pivot at predetermined timing relative to the vertical up-down movement of the needle bar 23; and a guide member 26 mounted to the lower end of the guide lever 25 for directing or guiding the string-shaped member A to a needle drop position (sewing position) of the sewing needle 27. The sewing machine sequentially sews the string-shaped member A onto the fabric through zigzag sewing by pivotally driving the guide lever 25 leftward and rightward of the needle drop position per vertical reciprocating movement of the needle bar 23 while controlling the rotation of the rotary member 24 in accordance with a moving direction of the embroidery frame 4, holding the fabric (not shown), in accordance with sewing control based on embroidery data.

Now, a description will be given about the details of the bobbin support device 5, with reference to FIGS. 3 and 5. As seen from FIGS. 3 and 5, support arms 6 are located to the left and right of the machine head 3 and fixed at their proximal end portions to the front surface of the machine frame 1 by means of bolts or the like. Each of the support arms 6 is fixed to the front surface of the machine frame 1 in such a manner that it extends horizontally forward (i.e., toward a reader of FIG. 3 and leftward of FIG. 4). Two connecting rods 7 are fixed to each of the support arms 6 and extend vertically toward the machine table 2 and embroidery frame 4; namely, a total of four connecting rods 7 are provided, although the number of the connecting rods 7 may be other than four.

A base member 8 is fixedly mounted to lower end portions of the connecting rods 7. As shown in FIG. 5, the base member 8 is a circular plate of a doughnut shape (i.e., ring or washer shape) having an opening portion 8*a* formed centrally therein, and the base member 8 has two pairs of left and right arm portions 9 provided on its underside and projecting leftward and rightward from the underside. The connecting rods 7 are fixed at their lower ends to distal end portions of the arm portions 9. The base member 8 is fixed to the lower ends of the connecting rods 7 via the arm portions 9 in parallel to the upper surface of the machine table 2 and with a given spacing secured from the upper surface of the machine table 2 such that the embroidery frame 4 can pass horizontally through the spacing under the base member 8. Stated differently, at least one of the fixed position of the support arms 6 on the front surface of the machine frame 1, length of the connecting rods 7 and thickness of the base member 8 are adjusted in advance in such a manner that the base member 8 and the machine table 2 (embroidery frame 4) can be positioned with the given spacing secured therebetween.

Further, a support member 10 is provided on the upper surface of the base member 8 in such a manner that it is rotatable about the axis of the needle bar 23 provided on the machine head 3 but immovable in the vertical or up-down direction. Like the base member 8, the support member 10 is a circular plate of a doughnut shape (i.e., ring or washer shape) having an opening portion 10*a* formed centrally therein. Unlike the base member 8, however, the support member 10 includes a transmission section 12 having a plurality of teeth (gear 11) formed on and along the outer periphery of the support member 10.

A bracket 13 is fixed to any one of the arm portions 9 (right rear arm 9 in FIG. 5) provided on the base member 8, and a drive motor 14 is fixed to the base member 8 via the bracket 13 and arm 9. A driving gear 15 is fixedly provided on the motor shaft of the drive motor 14 and held in meshing engagement with the gear 11 of the transmission section 12 formed on and along the outer periphery of the support member 10. According to the above-described arrangements, rotation of the motor shaft is transmitted to the support member 10 via the driving gear 15 and gear 11 as the motor 14 is driven, so that only the support member 10 can be rotated relative to the base member 8. A pair of bearing members 16 are provided on the upper surface of the support member 10, rotatable relative to the base member 8, in a vertically standing position. The bearing portions of these bearing members 16 rotatably support opposite end portions of corresponding bobbin shafts 17.

Collars 18 are fixedly provided on portions of the corresponding bobbin shafts 17 near the opposite ends thereof in abutment against the inner surfaces of the bearing members 16, so as to regulate left and right axial positions of the bobbin shafts 17 (limit axial displacement of the bobbin shafts 17 in a left-right direction in FIG. 5). Further, a pair of retention members 19 are provided on the corresponding bobbin shafts 17 inwardly of the collars 18 in such a manner that the retention members 19 are not only rotatable but also slidable in the axial direction of the bobbin shafts 17. The retention members 19 each have a tapering outer peripheral surface, although not particularly shown. Namely, each of the retention members 19 gradually increases in diameter in a direction from its inner side, opposed to the inner side of the other retention member 19, toward its outer side. A bobbin 20 having a string-shaped material, such as a tape or cord, wound thereon can be detachably mounted between the retention members 19. When mounting a bobbin 20, the bobbin 20 is positioned between the opposed retention members 19 with opposite end portions of the bobbin 20 supported by the tapering outer peripheral surfaces of the bobbin 20. Namely, any one of various types of bobbins 20 can be reliably mounted on the bobbin shafts 17 in a fixed state, by the retention members 19 being appropriately moved toward or away from each other in accordance with the inner diameter of the bobbin 20. With the aforementioned arrangements, the bobbin 20 is allowed to revolve or circularly move around the machine head 3 generally about the axis of the needle bar 23 as the support member 10 is rotated by the drive motor 14.

Further, the support member 10 has a through-hole 21 of, for example, a rectangular shape formed in a predetermined portion thereof between the bearing members 16 that support the bobbin 20, i.e. in a predetermined bobbin-supporting portion positionally corresponding to the bobbin 20 to be supported. Thus, a lower part of the bobbin 20, mounted to the pair of retention members 19, is sunk down or received in the through-hole 21. Needless to say, the instant embodiment is arranged in such a manner that the lower part of the bobbin 20 received in the through-hole 21 is reliably prevented from contacting the base member 8. Thus, in a case where a large bobbin 20 of a particularly large diameter is mounted in place, and even when the large bobbin 20 has been circularly moved over to a rear side of the machine side 3 by rotation of the support member 10, the instant embodiment can prevent the large bobbin 20 from interfering with the machine frame 1 and thereby becoming no more revolvable around the machine head 3. However, the through-hole 21 need not necessarily be formed in the support member 10 if bobbins 20 (more particularly, amounts of string-shaped materials wound on the bobbins 20) are limited to diameters that do not hamper the rotation of the support member 10.

A pair of guide rods 22 are provided at, and project upward from, positions of the support member 10 between the bobbin-supporting portion and the machine head 3 and adjacent to the inner peripheral edge (inner-diameter side) of the support member 10. The string-shaped material A paid out from the bobbin 20 is passed between the guide rods 22 to be then fed to the machine head 3.

The following describe behavior of the embroidery sewing machine constructed in the above-described manner, and more particularly an example manner in which the string-shaped material A wound on the bobbin 20 is sewn onto a fabric (not shown), held on the embroidery frame 4, by lock stitching. First, the human operator pulls out the string-shaped material A would on the bobbin 20, passes the pulled-out string-shaped material A between the guide rods 22 and then feeds the string-shaped material A to the machine head 3, so that, in the machine head 3, the fed string-shaped material A is passed through the guide member 26 and directed to the needle drop position of the sewing needle 27. In this state, not only the embroidery frame, having a not-shown fabric set thereon, is moved in the X and Y directions (see FIG. 2) on the basis of predetermined embroidery data, but also the needle bar 23 is vertically driven to perform well-known lock stitching through cooperation between the sewing needle 27 and a not-shown rotary hook.

During that time, the rotary member 24 is rotationally controlled so that the guide member 26 is positioned ahead in a relative advancing direction of the machine head 3 based on the movement of the fabric, so that the string-shaped material A is appropriately direct to the needle drop position of the sewing needle 27. The guide lever 25 is driven to pivot at predetermined timing relative to the vertical movement of the needle bar 23, so that the string-shaped material A, having been guided to the needle drop position by the guide member 26 fixed to the lower end of the guide lever 25, is swung leftward and rightward per vertical reciprocating movement of the needle bar 23 (i.e., per switch). Thus, the string-shaped material A is sequentially sewn onto the fabric through so-called zigzag sewing.

As the string-shaped material A is sequentially sewn onto the fabric in the aforementioned manner, the support member 10 is driven to pivot by the drive motor 14 that is controlled in response to the rotation control of the rotary member 24, so that the bobbin 20 revolves around the machine head 3, i.e. along the rotational circumference of the support member 10, generally about the axis of the needle bar 23 so as to follow the rotation of the rotary member 24. Such rotation of the support 10 (and hence the bobbin 20) may be effected at the same timing and at generally the same speed as the rotation of the rotary member 24, through appropriate control of the drive motor 14, or may be effected with a slight delay from and at a slower speed than the rotation of the rotary member 24. Further, the pivoting movement of the support member 10 may be effect in any other suitable manner. For example, instead of the support member 10 being caused to pivot while constantly following the rotation of the rotary member 24, the support member 10 may be caused to pivot once a difference in rotational angle between the rotary member 25 (or guide member 26) and the support member 10 (e.g., middle position of the bobbin 20) reaches, for example, 45°.

According to the embodiment of the embroidery sewing machine, as described above, the bobbin 10 having the string-shaped material A wound thereon, is supported by the support member 10 that is rotatably provided over the machine table 2, and thus, the embodiment of the embroidery sewing machine can use bobbins 20 of increased sizes without bobbins 20 usable in the embodiment being significantly limited in size. Further, the support member 10 is subjected to orientation control in accordance with the rotation control of the rotary member 24, and thus, even when the rotary member 24 has been rotated through 360° or over, the bobbin 20 can be revolved similarly to the rotary member 24. In this way, the string-shaped material A can always be appropriately guided or directed to the needle drop position. Thus, no matter how the rotary member 24 has been rotated in accordance with sewing control based on embroidery data, it is possible to eliminate a possibility of the string-shaped material A twining or wrapping around the machine head 3 and getting tangled to the extent that the string-shaped material A cannot be appropriately directed to the needle drop position. As a result, the string-shaped material A can be appropriately sewn onto the sewing workpiece without limiting patterns to be formed on the sewing workpiece.

Furthermore, because the support member 10 for supporting the bobbin 20 is positioned at a lower position, generally close to the lower end of the machine head 3, as compared to the conventional counterpart, it is not necessary from the human operator to lift up the bobbin 20 high as was necessary in the conventionally-known sewing machines.

Whereas one preferred embodiment of the present invention has been described above with reference to the accompanying drawings, the present invention is not so limited, and it should be appreciated that various other embodiments and modifications are also possible. For example, whereas the embroidery sewing machine of the present invention has been described above as a single-head embroidery sewing machine provided with only one machine head 3, the present invention is not so limited, and the embroidery sewing machine of the present invention may be a multi-head embroidery sewing machine provided with a plurality of machine heads 3. In such a case, it goes without saying that a plurality of the above-described bobbin support devices 5 are provided in corresponding relation to the machine heads 3. In this case, whereas a separate drive motor 10 may be provided in each of the bobbin support devices 5, only one common drive motor 14 may be provided for simultaneously rotating the respective support members 10 of the bobbin support devices 5 so that rotation of the single drive motor 14 can be transmitted to the support members 10 of the bobbin support devices 5.

Note that a separate drive source for positively rotating the bobbin 20 may be provided so as to allow the string-shaped material A to be smoothly paid out from the bobbin 20.

Furthermore, the transmission section 12 may comprise a friction belt in place of the gear 11, and the driving gear 15 may be replaced with a friction roller or any other suitable means as long as the rotation of the drive motor 14 can be transmitted to the support member 10.

Furthermore, whereas the preferred embodiment of the embroidery sewing machine has been described above as sewing the string-shaped member A onto the sewing workpiece through so-called zigzag sewing, the present invention is of course not so limited.

Furthermore, whereas the preferred embodiment of the embroidery sewing machine has been described above as revolving the bobbin 20 along the rotational circumference of the support member 10 generally about the axis of the needle bar 23, the rotational circumference of the support member 10 may be other than a concentric circle, such as an ellipse, eccentric circle or the like.

The present application is based on, and claims priority to, Japanese Patent Application No. 2009-263256 filed on Nov. 18, 2009. The disclosure of the priority application, in its entirety, including the drawings, claims, and the specification thereof, is incorporated herein by reference.

What is claimed is:

1. A sewing machine comprising:

a vertically-driven needle bar;

a sewing needle mounted to a lower end portion of the needle bar;

a rotary member provided coaxially with the needle bar and freely rotatable about an axis thereof;

a bobbin having a string-shaped material wound thereon;

a guide member mounted to the rotary member for guiding the string-shaped material, paid out from the bobbin, to a needle drop position of the sewing needle, and which is constructed to sew the string-shaped material onto a sewing workpiece by lock stitching while not only controlling rotation of the rotary member in accordance with a moving direction of a sewing workpiece held on an embroidery frame that moves on and along a machine table on the basis of embroidery data but also changing an orientation of the guide member in such a manner as to optimize a direction in which the string-shaped material is to be guided to the needle drop position;

a support member for supporting the bobbin, the support member being rotatable generally about an axis of the needle bar and causing the bobbin to revolve around the axis of the needle bar in response to rotation of said support member; and a drive section for rotating said support member, the drive section being a drive source independent of a drive source for said rotary member, wherein said support member is disposed over the embroidery frame at a predetermined lower position in such a manner that the support member at least does not hamper movement of the embroidery frame, and wherein said support member has an opening portion formed therein to permit passage therethrough of the needle bar over a predetermined area including a center of rotation thereof so that said bobbin is mounted on the support member outside the opening portion.

2. The sewing machine as claimed in claim 1, wherein said drive section controls rotation of said support member to follow the rotation of said rotary member.

3. The sewing machine as claimed in claim 1, which further comprises a member for positioning and retaining said support member over the machine table at a predetermined height position such that said support member does not hamper movement of the embroidery frame.

4. The sewing machine as claimed in claim 1, wherein said support member has a through-hole formed in a portion thereof positionally corresponding to a bobbin to be supported by said support member, and wherein said support member supports the bobbin with a lower part of the bobbin received in the through-hole.

* * * * *